US006364169B1

(12) United States Patent
Knickerbocker

(10) Patent No.: US 6,364,169 B1
(45) **Date of Patent: *Apr. 2, 2002**

(54) ANTI CLOG TERMINAL ORIFICE FOR POWER DISPENSER

(76) Inventor: Michael G. Knickerbocker, 4516 Hillside Ct., Crystal Lake, IL (US) 60012

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/038,209

(22) Filed: Mar. 10, 1998

Related U.S. Application Data

(60) Provisional application No. 60/040,412, filed on Mar. 11, 1997.

(51) Int. Cl.[7] ..... B65D 83/06

(52) U.S. Cl. ..... 222/189.02; 222/480; 222/565

(58) Field of Search ..... 222/480, 565, 222/189.02, 556, 196.1, 564, 547

(56) References Cited

U.S. PATENT DOCUMENTS 915,742 A * 3/1909 Comings ..... 222/565
933,507 A * 9/1909 Weber ..... 222/196.1
2,159,259 A 5/1939 Dootson
2,527,813 A 10/1950 Hansen
2,729,363 A 1/1956 Bauer et al.
3,031,107 A 4/1962 Lococo
3,151,781 A 10/1964 McKee
3,424,351 A 1/1969 Cilluffo et al.
3,563,417 A 2/1971 Jordan et al.
4,051,981 A 10/1977 Nandlak
5,219,100 A 6/1993 Beck et al.

FOREIGN PATENT DOCUMENTS

DE 922013 * 11/1954 ..... 222/196.1

* cited by examiner

*Primary Examiner*—Steven O. Douglas
(74) *Attorney, Agent, or Firm*—Frijouf, Rust & Pyle, P.A.

(57) ABSTRACT

An anti-clog device for a terminal orifice of a dispenser is disclosed for dispensing a particulate material from the terminal orifice. The particulate material clusters into aggregates larger than the terminal orifice and are prevented from being dispensed through the terminal orifice. The anti-clog device comprises an array of projections disposed about the terminal orifice for dividing the large aggregates of particulate material into smaller aggregates of particulate material for dispensing through the terminal orifice.

24 Claims, 10 Drawing Sheets

PRIOR ART

PRIOR ART

ANTI CLOG TERMINAL ORIFICE FOR POWER DISPENSER

CROSS-REFERENCE TO RELATED APPLICATIONS

This application claims benefit of U.S. Patent Provisional application serial No. 60/040,412 filed Mar. 11, 1997. All subject matter set forth in provisional application serial No. 60/040,412 is hereby incorporated by reference into the present application as if fully set forth herein.

BACKGROUND OF THE INVENTION

1. Field of the Invention

This invention relates to dispensing and more particularly to a anti-clog terminal orifice for a powder dispenser for dispensing a particulate material.

2. Prior Art Statement

The prior art has known various types of dispensing devices for dispensing a particulate material such as a powder or a granulated material. Typically, the particulate material is contained within a receptacle and is dispensed through a terminal orifice. In some cases, the receptacle is a portable dispensing receptacle having an open top with a closure securable to the receptacle for closing the open top of the receptacle. The closure defines a terminal orifice for dispensing the particulate material through the terminal orifice from the receptacle. The closure includes a plug being movably mounted relative to the closure for insertion within the terminal orifice for closing the terminal orifice. Portable dispensing receptacles for dispensing particulate material incorporating these features have found wide and diverse use and success in the art.

One particular difficulty with portable dispensing receptacles for particulate material is the difficulty of clustering of the particulate material into aggregates or chunks. This is especially significant when the size of the aggregates or chunks is larger than a minimum dimension of the terminal orifice. In such event, the aggregates or chunks blocks the terminal orifice and inhibits further discharge of the particulate material from the receptacle.

Some in the prior art have attempted to alleviate the difficulty of clustering of the particulate material by incorporating various types of screen devices and the like. The screen devices were disposed within or upstream from the terminal orifice for inhibiting the aggregates or chunks from blocking the terminal orifice.

U.S. Pat. No. 2,159,259 to Dootson discloses a granulated sugar dispenser comprising a container for the sugar provided with a discharge neck. A closure at the outer end of the neck and a flow guard are arranged and adapted to restrict the flow of sugar from the container to the neck to flow from the outer end of the neck when the closure is opened. The neck has a transparent portion to show the amount of sugar flowing into the neck upon inverting the container.

U.S. Pat. No. 2,527,813 to Hansen discloses a dispensing device for comminuted material dispensing comprising a hollow cylindrical body having a closed bottom and an open top. A hollow convex cover for the open top has a reduced opening. A hollow cylindrical wire mesh member extends from the bottom of the body up to within a short distance of the cover and is spaced within the side walls of the cylindrical body and from the cover. Resilient arcuate retaining wire members are attached to the cylindrical wire mesh member bowed out to the interior surfaces of the side walls of the cylindrical body and hold the wire mesh member in position by friction. The open top of the cylindrical body have substantially the same internal diameter as the body throughout the length.

U.S. Pat. No. 2,729,363 to Bauer et al discloses a non-cloggable dispenser for powdered material open at the top. A conical cover for the container is removably secured to the open top. The cover has an opening at the apex thereof. An insert of circular shape fits within the sides of the cover and resting on the top edges of the container. The insert comprises a conical spring formed from a continuous wire and having an outer ring resting on the top edges of the container within the cover. The cover at the conical sides thereof abut the top of the outer ring whereby to retain the spring on the top edges of the container. The apex of the spring extends downwardly toward the bottom of the container.

U.S. Pat. No. 3,031,107 to Lococo discloses a holder and dispenser for sugar or the like comprising a container having a receptacle portion for sugar and being open at a top thereof. A hollow cover has means attaching the same to the open end portion of the container and has a shoulder overlying the adjacent edge of the container. The hollow portion of the cover is adapted to trap the sugar and funnel the same through a discharge opening provided in the cover. An insertable and removable lump disintegrating screen embodies a plurality of horizontal boar-like members interconnected with complemental horizontal bar-like members at right angles to the first-named bar-like members and defining a multiplicity of sugar discharging openings. The bar-like members is integral with and surrounded by a screen-positioning and retaining rim. The screen spans the open top of the container and separates the receptacle portion from the hollow portion of the cover. The rim is interposed and clampingly held between the top of the container and the shoulder. The rim is compressibly resilient for constituting a retainer for the screen and having the additional function of a gasket, the bar-like members having V-shaped upper portions and V-shaped lower portions defining upper and lower knife-like lump cutting and disintegrating means.

U.S. Pat. No. 3,151,781 to McKee discloses a screening device comprising a horizontal plate having rows of openings extending therethrough. The plate is provided with a plurality of rigid horizontally-elongated spacer elements arranged in series between the rows of openings and also projecting in a direction normal to the plane of the plate. The elements of each of the series is spaced apart to define feed passages for the flow of granular material into and through the openings and is provided with longitudinally-spaced transverse notches permitting the flow of relatively small particles therethrough and through the openings while large lumps of material are restrained by the elements.

U.S. Pat. No. 3,424,351 to Cullufo discloses a container for granular products comprising an outlet structure having an opening through which the product can be poured or shaken or can be removed by a spoon. A plurality of resilient elements extend into the opening and form obstructions for breaking up lumps of the granular product when the product is poured or shaken from the container, but the elements are resiliently deflectable to enable a spoon to be admitted through the opening.

U.S. Pat. No. 3,563,417 to Jordan discloses a dispensing grid for use in a dispenser for solid, particulate matter, such as salt, features rounded upper surfaces and wedge-shaped lower surfaces. The intersecting ribs comprises the grid preferably being at two levels. The grid is preferably disposed on an interior surface of the dispenser, across an opening through which dispensed material may pass, and beneath a flush-fitting closure. The rounded upper surfaces minimize salt entrapment beneath the flush-fitting closure, and the chisel-point lower surfaces break up agglomerated lumps of the material.

U.S. Pat. No. 4,051,981 to Mandlak discloses a powder gun for dispensing a powder such as an insecticide or the like characterized by a hollow collapsible body for containing the powder. A dispensing member has a discharge port and spout for directing the discharged powder into the desired area and connected with the hollow collapsible body. A filter and lump break up means disposed within the dispensing member immediately adjacent the discharge port for breaking up lumps and for filtering the powder and preventing entry of particles large enough to plug the discharge port and spout. The hollow collapsible body is normally biased to an extended position and movable to a compressed position for discharging air and any powder therewithin through the dispensing member. Also disclosed are preferred structural embodiments including a rotatable disc having multiple sections of stalks protruding substantially perpendicularly thereto for breaking up the lumps and for filtering the powder dispensed through the discharge spout, as well as preferred materials of construction.

U.S. Pat. No. 5,219,100 to Beck et al discloses a closure for a container opening including a closure body having a predetermined configuration, external periphery and a first aperture formed therethrough. A member connects the closure body about the container opening with a cover member being reciprocally mounted about a portion of the external periphery of the closure body. The cover member includes a first lid member hingedly connected thereto for rotation with respect to the cover member and the closure body and closing engagement with the first aperture. A first locking member releasably retains the first lid member a predetermined distance away from the first aperture to maintain the first aperture in an uncovered condition during dispensing of the container contents. The first locking member includes at least one engagement wing integral with the first lid member for engaging a portion of the closure body.

Therefore, it is an object of the present invention to provide an anti-clog device for a terminal orifice of a dispenser for dispensing a particulate material from the terminal orifice that can disperse large aggregates or chunks into smaller aggregates or chunks for discharge through the terminal orifice.

Another object of this invention is to provide an anti-clog device for a terminal orifice of a dispenser for dispensing a particulate material from the terminal orifice that is integrally formed into the surface defining the terminal orifice as a unitary member.

Another object of this invention is to provide an anti-clog device for a terminal orifice of a dispenser for dispensing a particulate material from the terminal orifice incorporating an array of projections with each of the projections having a pointed end for breaking up the aggregates or chunks of the particulate material.

Another object of this invention is to provide an anti-clog device for a terminal orifice of a dispenser for dispensing a particulate material from the terminal orifice incorporating an array of projections with each of the projections having a sharp lateral edge for cutting the aggregates or chunks of the particulate material.

Another object of this invention is to provide an anti-clog device for a terminal orifice of a dispenser for dispensing a particulate material from the terminal orifice incorporating an array of projections with each of the projections having a plurality of teeth for cutting the aggregates or chunks of the particulate material.

Another object of this invention is to provide an anti-clog device for a terminal orifice of a dispenser for dispensing a particulate material from the terminal orifice that is incorporated into a closure.

Another object of this invention is to provide an anti-clog device for a terminal orifice of a dispenser for dispensing a particulate material from the terminal orifice that is incorporated into a closure and which does not appreciably increase the cost of the closure over the closure of the prior art.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention with in the scope of the invention. Accordingly other objects in a full understanding of the invention may be had by referring to the summary of the invention and the detailed description describing the preferred embodiment of the invention.

SUMMARY OF THE INVENTION

A specific embodiment of the present invention is shown in the attached drawings. For the purpose of summarizing the invention, the invention relates to an anti-clog device for a terminal orifice of a dispenser is disclosed for dispensing a particulate material from the terminal orifice. In many cases, the particulate material clusters into aggregates larger than the terminal orifice and are prevented from being dispensed through the terminal orifice. The anti-clog device comprises projections disposed about the terminal orifice. Each of the projections defines a pointed distal end enabling of projections to divide the large aggregates of particulate material into smaller aggregates of particulate material for dispensing through the terminal orifice.

In a first embodiment of the invention, each of the projections are spaced relative to one another at a distance less than a minor dimension of the terminal orifice. Each of the projections has a longitudinal length at least one-half of the minor dimension of the terminal orifice. In a second embodiment of the invention, each of the projections has a plurality of teeth for cutting the aggregates or chunks of the particulate material.

In a specific embodiment of the invention, the terminal orifice is defined in a generally planar surface. The projections are formed in an array of projections with each of the projections of the array having a proximal end being unitary with the planar surface of the closure. The closure maybe removably securable to a receptacle for receiving the particulate material. Each of the projections extends outwardly from and substantially normal to the planar surface.

In another embodiment of the invention, the terminal orifice is substantially circular defined by a diameter. Each of the projections of the array extends from the planar surface a distance greater than one-half of the diameter of the terminal orifice.

In another embodiment of the invention, each of the projections of the array has a sharp lateral edge for cutting the aggregates of the particulate material. Preferably, each of the projections of the array has plural sharp lateral edges located on opposed sides of each of the projections for cutting the aggregates of the particulate material.

The terminal orifice may comprise a plurality of terminal orifices. The array of projections comprises a plurality of arrays of projections with an array of projections encircling each of the plurality of terminal orifices of the array of terminal orifices. In the alternative, the array of projections may comprise a plurality of projections with each of the array of projections being interposed between each of the plurality of the arrays of terminal orifices.

The foregoing has outlined rather broadly the more pertinent and important features of the present invention in order that the detailed description that follows may be better understood so that the present contribution to the art can be more fully appreciated. Additional features of the invention will be described hereinafter which form the subject matter of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention.

BRIEF DESCRIPTION OF THE DRAWINGS

For a fuller understanding of the nature and objects of the invention, reference should be made to the following detailed description taken in connection with the accompanying drawings in which.

DETAILED DISCUSSION

Figure 1:
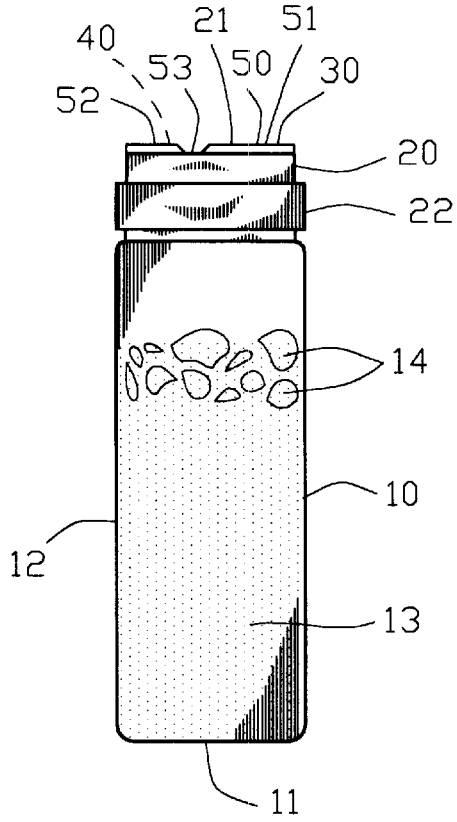
FIG. 1 PRIOR ART
FIG. 1 is an elevational view of a receptacle having a prior art closure for containing a particulate material.

FIG. 1 is an elevational view of a receptacle 10 having a bottom 11 and sidewall means 12 for containing a particulate material 13. The particulate material 13 may be a powdered material, a granulated material or the like such as sugar, salt, graded cheese, spices or any other type of material having the propensity for clustering into large aggregates or chunks 14.

Figure 2:
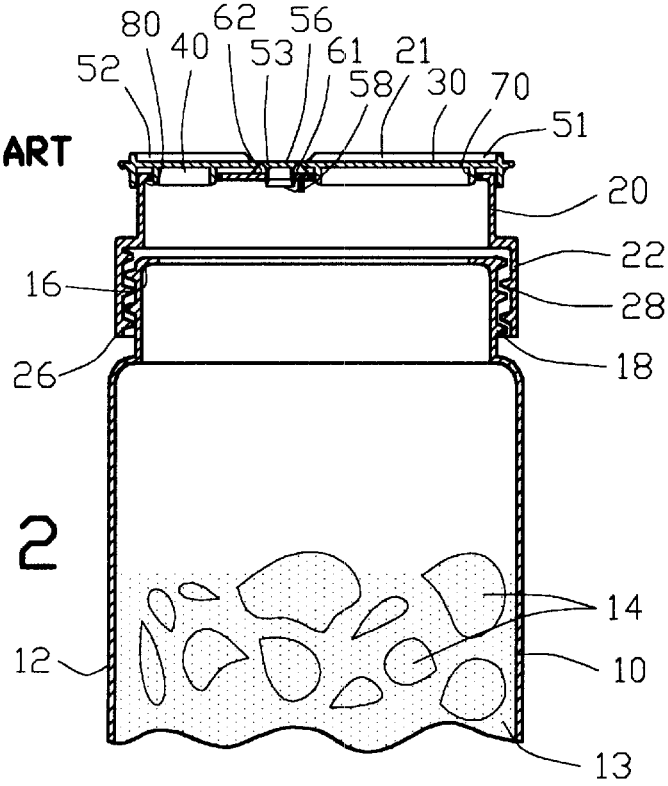
FIG. 2 is an enlarged sectional view of a portion of FIG. 1.

FIG. 2 is an enlarged sectional view of a portion of FIG. 1. The receptacle 10 includes a peripheral rim 16 defining threads 18. Preferably, the threads 18 are integrally formed with the receptacle 10 about the peripheral rim 16 for removably securing a closure 20 as will be described hereinafter. Although the receptacle 10 has been shown as cylindrical having a single cylindrical sidewall means 12, it should be understood that any type of receptacle may be utilized with the present invention as will become apparent hereinafter.

Figure 3:
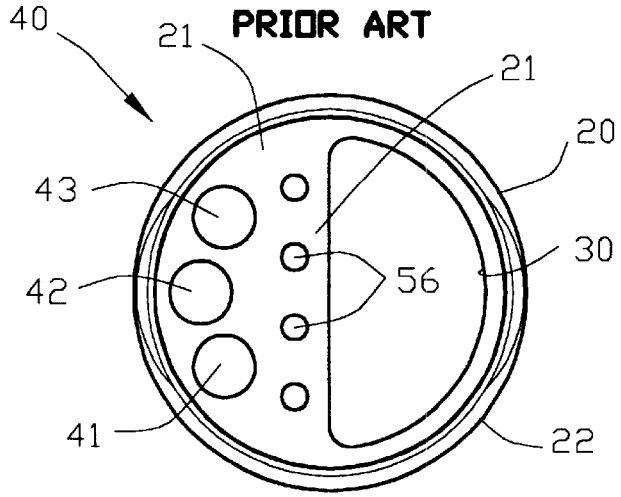
FIG. 3 is a sectional view along line 3—3 in FIG. 4.
Figure 4:
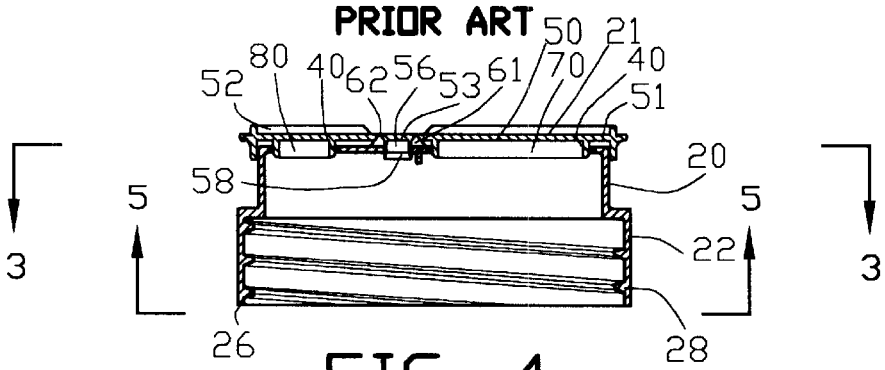
FIG. 4 is a side sectional view of the closure of FIG. 2.
Figure 5:
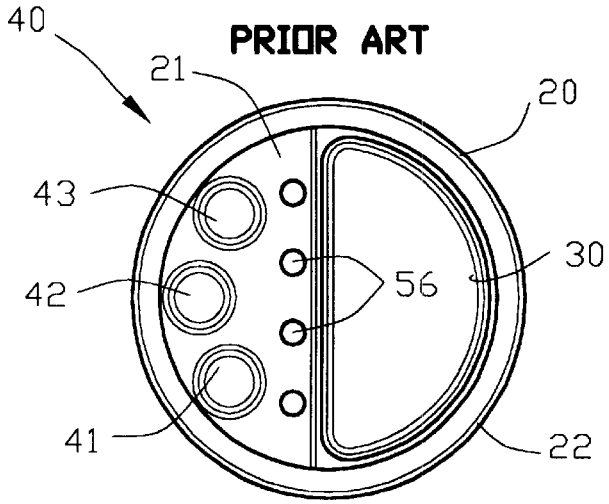
FIG. 5 is a sectional view along line 5—5 in FIG. 4.

FIGS. 3–5 illustrates various sectional views of the closure 20 of FIG. 2. The closure 20 comprises a planar surface 21 and sidewall means 22 with the sidewall means 22 defining a peripheral rim 26. The peripheral rim 26 supports threads 28 for threadably securing with the threads 18 of the receptacle 10 for removably securing the closure 20 to the receptacle 10.

The closure 20 includes a large terminal orifice 30 defined in the planar surface 21. The large terminal orifice 30 is used for pouring or spooning the particulate material 13 from the receptacle 10 through the large terminal orifice 30 of the closure 20. In addition, the closure 20 includes a small terminal orifices 40 shown as a plurality of small terminal orifices 41–43 defined in the planar surface 21 with each of the plurality of small terminal orifices 41–43 being significantly smaller than the large terminal orifice 30. The small terminal orifices 41–43 may be obstructed or clogged by the aggregate or clump 14 of the particulate material 13.

The closure 20 includes a closing element 50 having a first and second side portions 51 and 52 and a central portion 53. The central portion 53 is affixed to the closure 20 by plurality of bosses 56 resiliently engaging with a plurality of apertures 58 defined in the planar surface 21 of the closure 20. The first and second side portions 51 and 52 are secured to the central portion 53 by a first and a second integral hinge 61 and 62.

The first portion 51 is pivotable on the first integral hinge 61 for movement between a closed position and an open position. The first portion 51 includes a large boss 70 for resiliently engaging with the large terminal orifice 30 when the first portion 51 is in the closed position as shown in FIGS. 1 and 2. The resilient engagement of the large boss 70 with the large terminal orifice 30 seals the large terminal orifices 30 as should be well known to those skilled in the art.

In a similar manner, the second portion 52 is pivotable on the second integral hinge 62 for movement between a closed position shown in FIGS. 1 and 2 and an open position shown in FIGS. 3 and 4. The second portion 52 includes a small boss 80 shown as a plurality of small bosses 81–83 for resiliently engaging with the plurality of small terminal orifices 41–43. The resilient engagement of the plurality of small bosses 81–83 with the plurality of small terminal orifices 41–43 seals the small terminal orifices 40 as should be well known to those skilled in the art.

Although the small terminal orifices are shown as circular terminal orifices defining a diameter ($O_d$), it should be understood that the small terminal orifices may be of various types and sizes having a maximum dimension $O_{max}$ and the minimum dimension $O_{min}$ as illustrated by the large terminal orifice 30.

Figure 6:
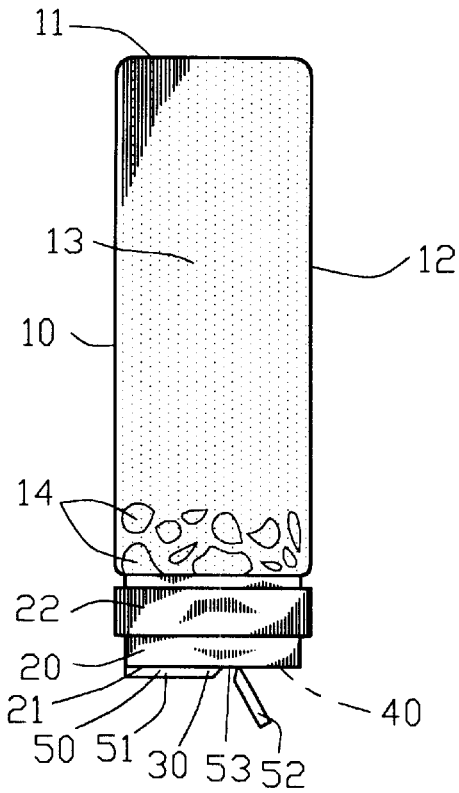
FIG. 6 PRIOR ART
FIG. 6 is an elevational view of the receptacle and the prior art closure of FIG. 1 in an inverted dispensing position.
Figure 7:
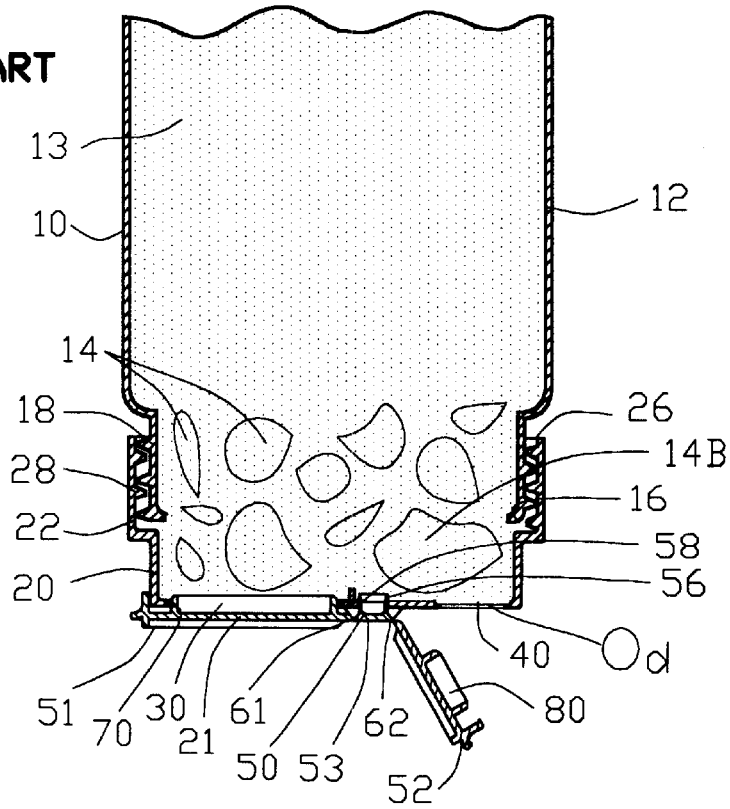
FIG. 7 is an inverted view of FIG. 2 in a dispensing position.

FIGS. 6 and 7 are elevational views of FIGS. 1 and 2 in an inverted dispensing position. The particulate material 13 has the tendency of clustering into aggregates or chunks 14 which may be formed larger than the minimum dimension of the small terminal orifices 40. When a large aggregate or chunk 14 engages with the small terminal orifice 40, the small terminal orifice 40 is blocked by the large aggregate or chunk 14B to inhibit further discharge from the small terminal orifice 40. The small terminal orifices 40 are shown being blocked or clogged by aggregates or chunks 14 of the particulate material 13 in a size larger than the small terminal orifices 40. For example, the aggregate or chunk 14B is of a size larger than the small terminal orifices 40. The aggregate or chunk 14B has a major dimension $A_{maj}$ and/or a minor dimension $A_{min}$. Each of the major dimension $A_{maj}$ and the minor dimension $A_{min}$ of the aggregate or chunk 14B is greater than the diameter $O_d$ of the small terminal orifices 40.

Although closure 20 was received with wide spread use and acceptance in the prior art, the closure 20 of the prior art suffered from this blocking or clogging by aggregates or chunks 14 of the particulate material 13.

Figure 8:
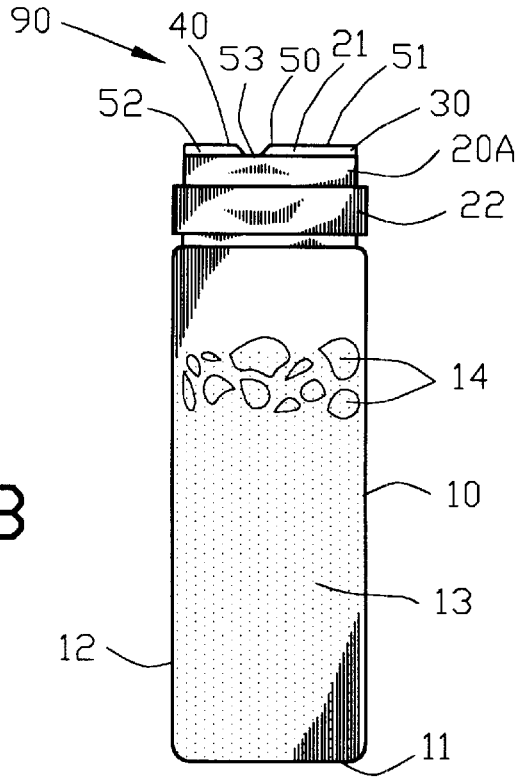
FIG. 8 is an elevational view of a receptacle having a closure for containing a particulate material with the improved anti-clog device incorporated therein.
Figure 9:
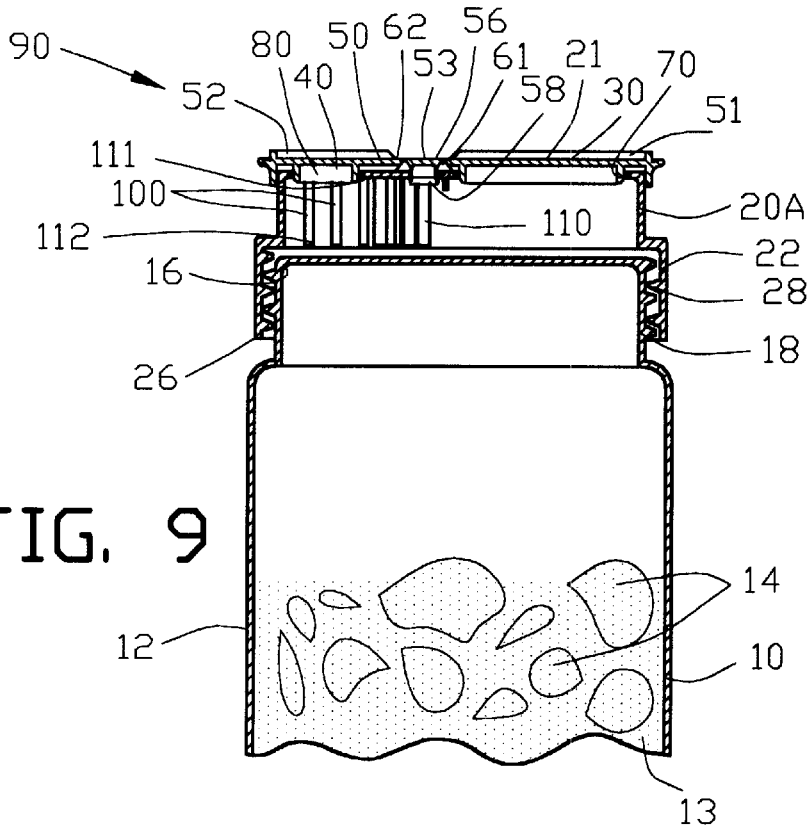
FIG. 9 is an enlarged sectional view of a portion of FIG. 8.

FIGS. 8 and 9 are elevational views of a receptacle 10 having a closure 20A for containing the particulate material 13 with the improved anti-clog device 90 incorporated therein. The anti-clog device 90 comprises an array 100 of projections 110 disposed about each of the small terminal orifices 40 for dividing the large aggregates of particulate material 14 into smaller aggregates of particulate material for dispensing through the plurality of small terminal orifices 40.

Figure 10:
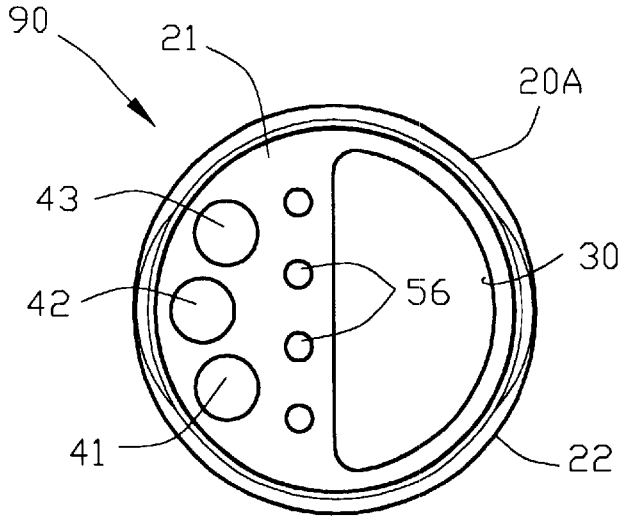
FIG. 10 is a sectional view along line 10—10 in FIG. 11.
Figure 11:
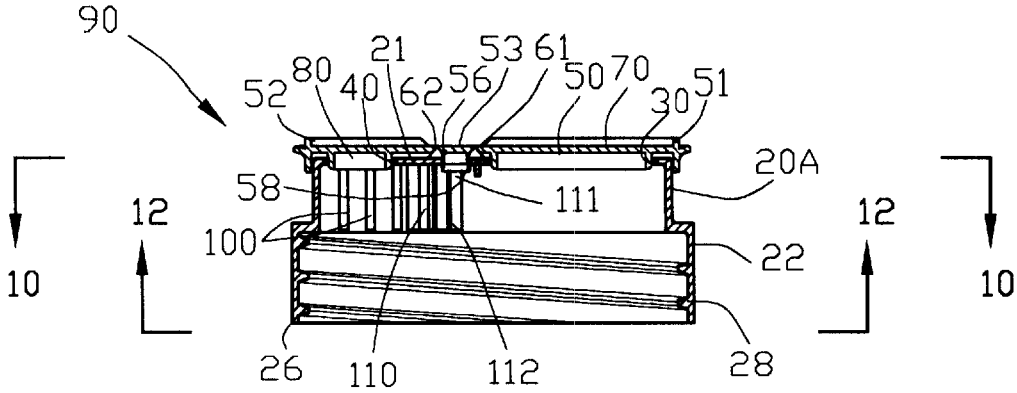
FIG. 11 is a side sectional view of the closure of FIG. 9.
Figure 12:
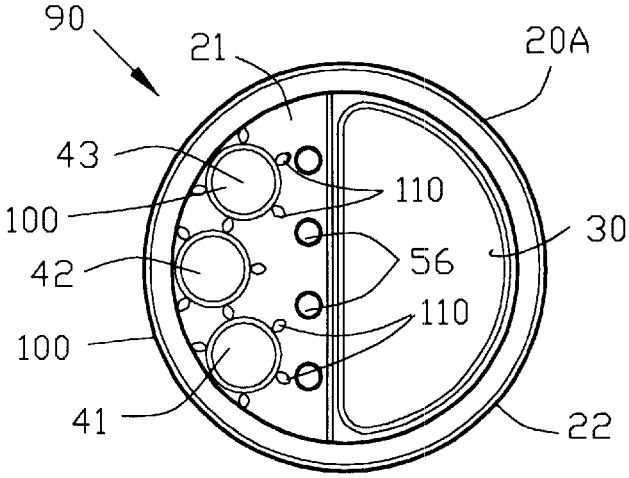
FIG. 12 is a sectional view along line 12—12 in FIG. 11.

FIGS. 10–12 illustrates various sectional views of the first embodiment of the closure 20A of FIG. 9. In this example, the array 100 comprises arrays 101–103 respectively disposed about the small terminal orifices 41–43. Each of the plurality of projections 110 has a proximal end 111 and a distal end 112. The proximal ends 111 of each of the plurality of projections 110 is secured to the planar surface 21 of the closure 20A. The plurality of projections 110 extend outwardly from the planar surface 21 to be substantially perpendicular or normal to the planar surface 21. Preferably, the proximal ends 111 of each of the plurality of projections 110 is integrally formed with the planar surface 21 of the closure 20A to be a unitary member.

Figure 13:
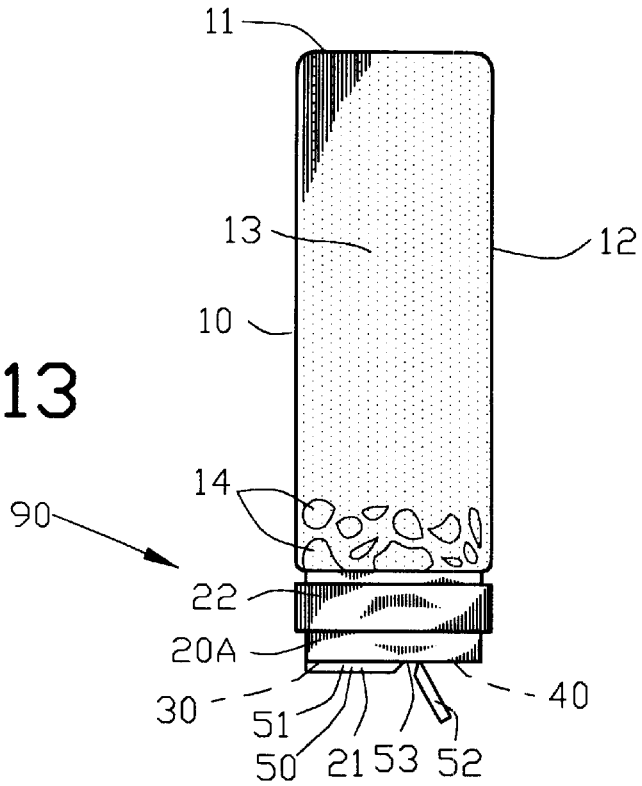
FIG. 13 is an elevational view of the receptacle and closure of FIG. 8 in an inverted dispensing position.
Figure 14:
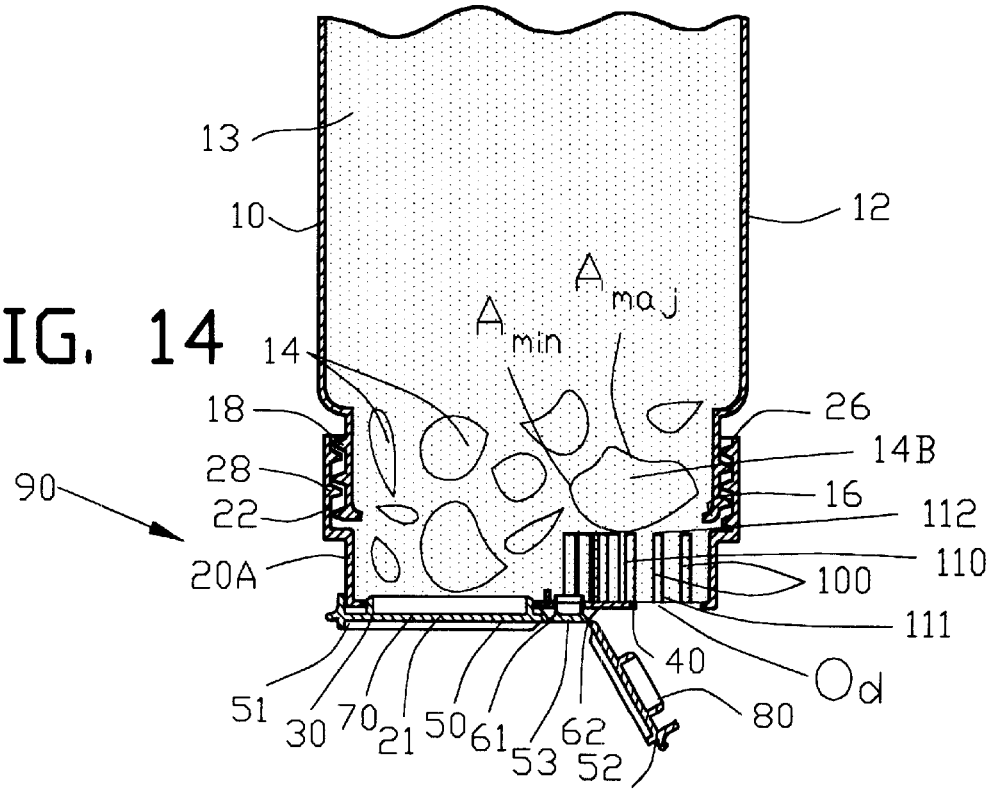
FIG. 14 is an inverted view of FIG. 9 in a dispensing position.

FIGS. 13 and 14 are elevational views of FIGS. 8 and 9 in an inverted dispensing position. As best sown in FIG. 14, the aggregate or chunk 14B is of a size larger than the small terminal orifices 40. The aggregate or chunk 14B has a major dimension $A_{maj}$ and a minor dimension $A_{min}$. Each of the major dimension $A_{maj}$ and/or the minor dimension $A_{min}$ of the aggregate or chunk 14B is greater than the diameter $O_d$ of the small terminal orifices 40. In the prior art closure 29 as shown in FIGS. 1–7, the small terminal orifices 40 would be blocked or clogged by aggregates or chunks 14 of the particulate material 13.

In contrast to the prior art closure 20, the array 100 of projections 110 disposed about the small terminal orifices 40 of the closure 20A of the present invention divides the large aggregates of particulate material 14B into smaller aggregates of particulate material 13. The smaller aggregates of particulate material 13 may be dispensed through the plurality of small terminal orifices 40. The large aggregates of particulate material 14B are divided into smaller aggregates of particulate material 13 upon agitation or shaking of the receptacle 10 by an operator. The agitation or shaking of the receptacle 10 by an operator propels the large aggregates of particulate material 14B into contact with the projections 110 whereat the large aggregates of particulate material 14B are divided or broken into smaller aggregates of particulate material 13.

Figure 15:
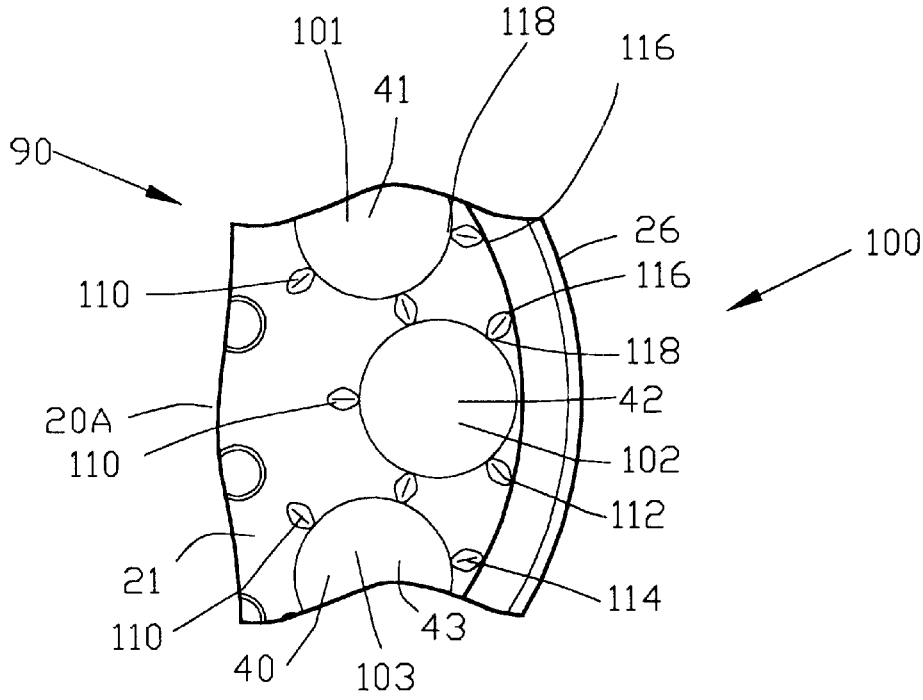
FIG. 15 is a sectional view along line 15—15 in FIG. 16.
Figure 16:
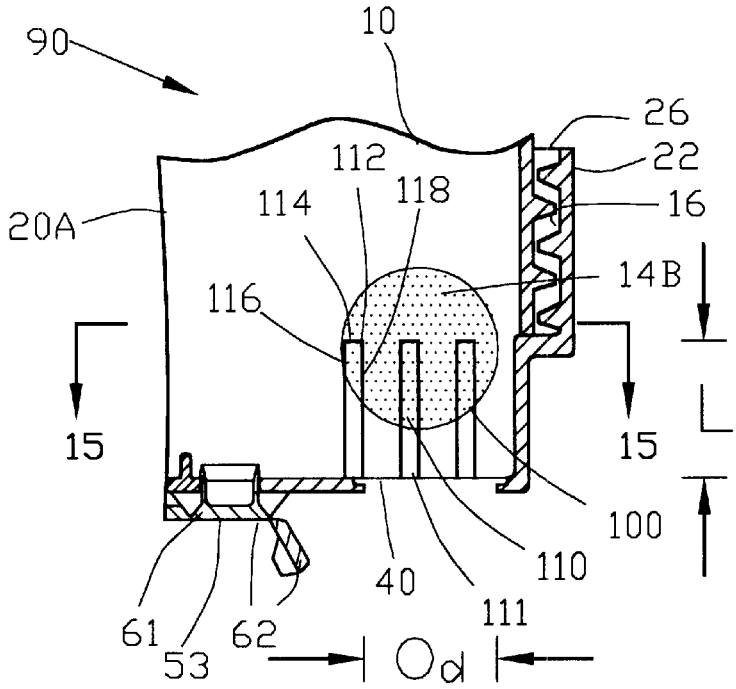
FIG. 16 is an enlarged view of a portion of FIG. 14.

FIGS. 15 and 16 are enlarged views of a portion of FIG. 14. Each of the projections 110 of the arrays 100 defines a pointed end 114. The pointed ends 114 of the projections 111 divide or break up the aggregates or chunks 14 of the particulate material 13 upon impact with the pointed ends 114 of the projections 111 during agitation or shaking of the receptacle 10 by the operator.

Each of the projections 110 has a sharpened lateral surface. In this embodiment, each of the projections 110 have a multiplicity of sharpened lateral surfaces 116 and 118 disposed on opposed surfaces of the projection 110. The sharpened lateral surfaces 116 and 118 act to severe aggregates or chunks 14 of the particulate material 13 into more minute aggregates or chunks.

Each of the projections 110 of the array 100 has a longitudinal length (L) from the proximal end 111 to the distal end 112. Preferably, each of the projections 110 has a longitudinal length (L) from the proximal end 111 to the distal end 112 at least one-half the a minor dimension ($O_{min}$) of the small terminal orifice 40. In this example, the small terminal orifices 40 is substantially circular in shape having an equal minor and major dimension being the diameter ($O_d$) of the small terminal orifices 40. Accordingly, the minor dimension ($O_{min}$) of the small terminal orifices 40 is equal to the diameter ($O_d$). In the event that the small terminal orifice 40 is of a different shape such as an oval or the like, the minor dimension ($O_{min}$) would be defined by the distance between the closest two edges of the small terminal orifice 40 whereas the major dimension ($O_{maj}$) would be defined by the distance between the two edges of the extreme of the orifice.

Each of the projections 110 of the array 100 is spaced from one another by a spacing (S). In this embodiment of the invention, five (5) projections 110 are equally spaced about the circumference of the small terminal orifice 40. The approximate spacing (S) may be determined by:

$$S = \frac{D}{N}$$

where N is the number of projections spaced about the orifice, and

D is the diameter of the orifice.

Accordingly, the spacing (S) of five (5) projections 110 equally spaced about the circumference of the small terminal orifice 40 is $0.63(O_d)$ where ($O_d$) is the diameter of the small terminal orifices 40.

The relationship between the longitudinal length (L) of each of the projections 110 and the minor dimension ($O_{min}$) of the small terminal orifice 40 ensures that all large aggregates or chunks 14 of the particulate material 13 larger than the small terminal orifice 40 will engage with projections 110 disposed on opposed sides of the minor dimension ($O_{min}$) of the small terminal orifice 40. Accordingly aggregates or chunks 14 of the particulate material 13 which are larger than the minor dimension ($O_{min}$) of the small terminal orifice 40 are ensured to engage with the pointed end 114 of each of the projections 110 of the array 100. The pointed terminal ends 114 of each of the projections 110 divide or break up the large aggregates or chunks 14 into smaller portions capable of passing through the small terminal orifice 40.

The sharpened lateral surfaces 116 and 118 act to severe the large aggregates or chunks 14 of particulate material 13 into more minute aggregates or chunks. When five (5) projections 110 are spaced about of the small terminal orifice 40, the spacing (S) between adjacent projections 110 is $0.63(O_d)$ where $(O_d)$ is the diameter of the small terminal orifices 40. Accordingly, the lateral sharpened surfaces 116 and 118 will break up chunks that are smaller than the chunks that are dispersed by the pointed ends 114 of the projections 110.

Figure 17:
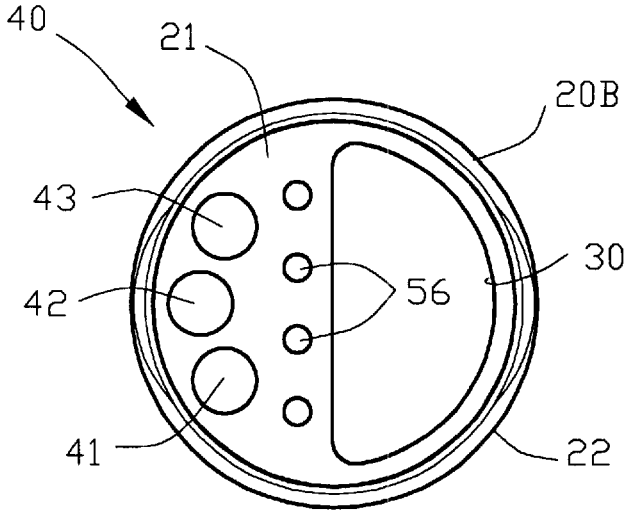
FIG. 17 is a sectional view along line 17—17 in FIG. 18.
Figure 18:
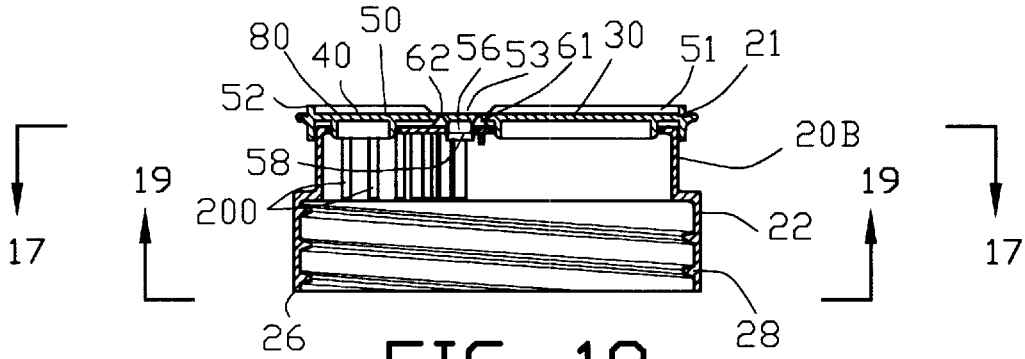
FIG. 18 is a side sectional view of a second embodiment of the closure of FIG. 9.
Figure 19:
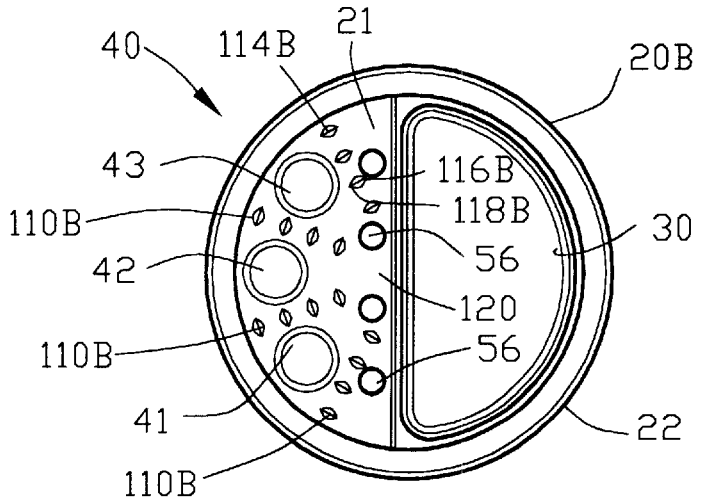
FIG. 19 is a sectional view along line 19—19 in FIG. 18.

FIGS. 17–19 illustrates various sectional views of a second embodiment of a closure 20B. In this second embodiment of the invention, the arrays 100B of projections 110B are radially disposed about a center 120 of the closure 20B. Each of the radial arrays 100B of projections 110B extend on opposed sides of one of the small terminal orifices 41–43.

The spacing (S) of five (4) projections 110B of each of the arrays 110B are equally spaced about the radial lines radiating from the center 120 of a closure 20B. Each of the projections 110B ensures that all large aggregates or chunks 14 of the particulate material 13 will engage with the pointed terminal ends 114B of each of the projections 110B to divide or break up the large aggregates or chunks 14 into smaller portions capable of passing through the small terminal orifice 40.

The sharpened lateral surfaces 116B and 118B of each of the projections 110B act to severe the large aggregates or chunks 14 of particulate material 13 into more minute aggregates or chunks. Accordingly, the lateral sharpened surfaces 116B and 118B will break up chunks that are smaller than the chunks that are dispersed by the pointed ends 114B of the projections 110B.

Figure 20:
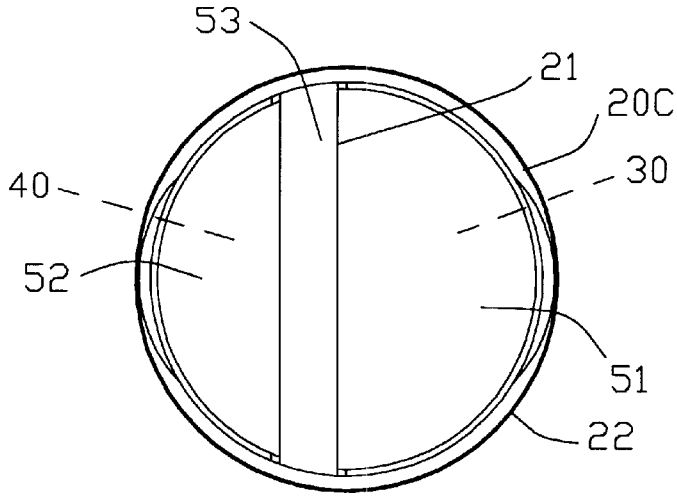
FIG. 20 is a sectional view along line 20—20 in FIG. 21
Figure 21:
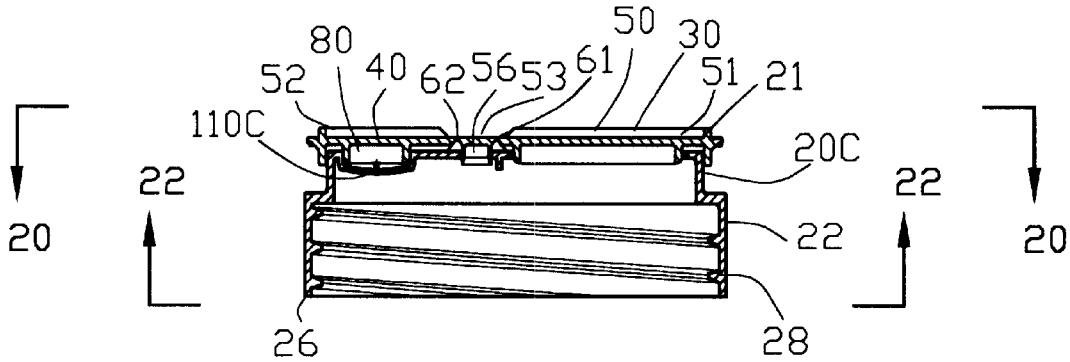
FIG. 21 is a side sectional view of a third embodiment of the closure of FIG. 9.
Figure 22:
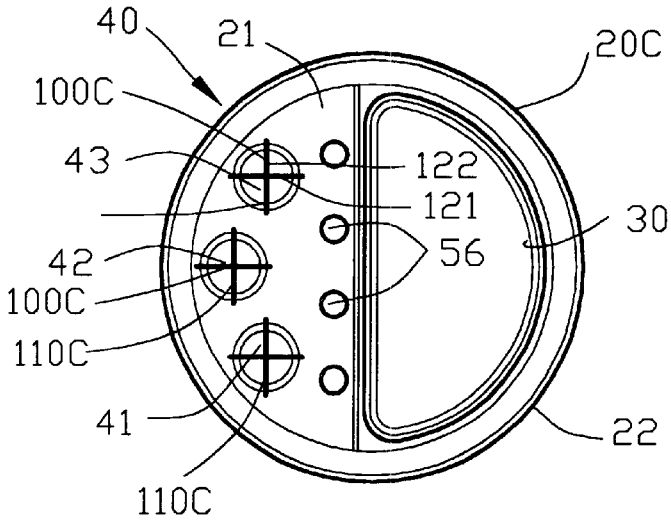
FIG. 22 is a sectional view along line 22—22 in FIG. 21.

FIGS. 20–22 illustrates various sectional views of a third embodiment of a closure 20C. In this third embodiment of the invention, the arrays 100C of projections 110C are disposed about the small terminal orifices 41–43.

Figure 23:
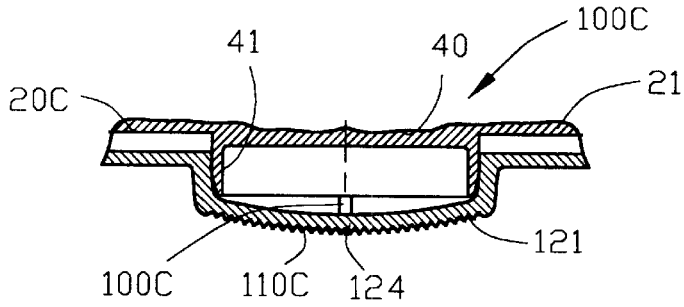
FIG. 23 is an enlarged view of a portion of FIG. 21.
Figure 24:
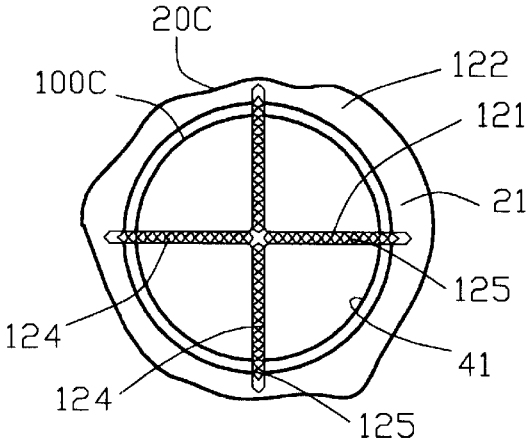
FIG. 24 is a bottom view of FIG. 23.
Figure 25:
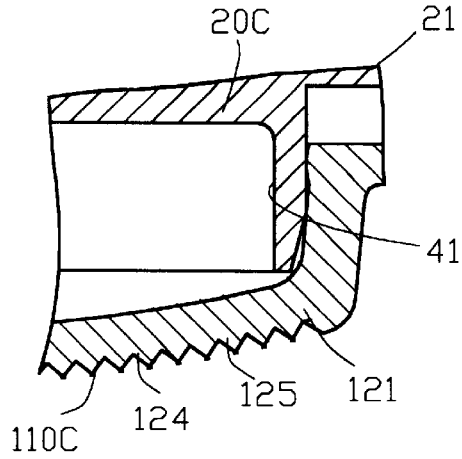
FIG. 25 is a magnified view of a portion of FIG. 23.

FIG. 23 is an enlarged view of a portion of FIG. 21 with FIG. 24 being a bottom view of FIG. 23. FIG. 25 is a magnified view of a portion of FIG. 23. Each of the arrays 100C of projections 110C comprises a first and a second projections 121 and 122 disposed substantially perpendicular to one another. Each of the first and second projections 121 and 122 defines a serrated edge 124 having a plurality of teeth 125. The plurality of teeth 125 of the serrated edges 124 of the first and second projections 121 and 122 act to severe the large aggregates or chunks 14 of particulate material 13 into more minute aggregates or chunks.

Figure 26:
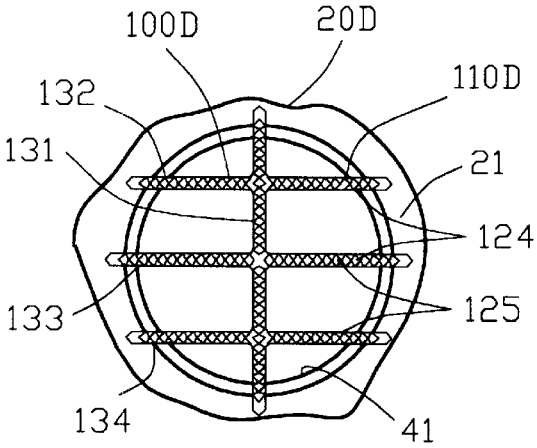
FIG. 26 is a first variation of the embodiment shown in FIG. 24.

FIG. 26 is a first variation of the third embodiment of the invention shown in FIG. 24. In this first variation of the third embodiment of the invention, the array 100D of projections 110D are disposed in a rectangular array 110D about the small terminal orifices 41–43. The array 100D of projections 110D comprises a projection 131 and cross projections 132–134 disposed substantially perpendicular to the projection 131. The projection 131 and the cross projections 132–134 create a grid of serrated edges 124 having a plurality of teeth 125. The grid of serrated edges 124 is established to severe the smaller aggregates or chunks 14 of particulate material 13 than the first and second projections 121 and 122 of the arrays 100C of the third embodiment of a closure 20C shown in FIGS. 20–22.

Figure 27:
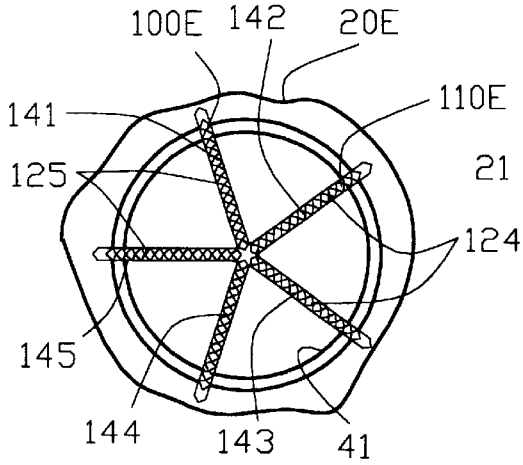
FIG. 27 is a second variation of the embodiment shown in FIG. 24. Similar reference characters refer to similar parts throughout the several Figures of the drawings.

FIG. 27 is a second variation of the third embodiment of the invention shown in FIG. 24. In this second variation of the third embodiment of the invention, the array 100E of projections 110E are disposed in a star array 110E about the small terminal orifices 41–43. The array 100E of projections 110E comprises a projection 141–144 disposed radially from a center of each of the small terminal orifices 41–43. The projection 141–144 create a grid of serrated edges 124 having a plurality of teeth 125. The grid of serrated edges 124 is established to severe the smaller aggregates or chunks 14 of particulate material 13 than the third embodiment of a closure 20C shown in FIGS. 23–25 as well as the first variation of the third embodiment of the invention shown in FIG. 26.

Although the invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An anti-clog device for a terminal orifice of a dispenser for dispensing a particulate material from the terminal orifice, the particulate material clustering into aggregates larger than the terminal orifice and being prevented from being dispensed through the terminal orifice, the improvement comprising:

an array of projections disposed about the terminal orifice;

each of said projections in said array being spaced relative to one another at a distance less than a minor dimension of the terminal orifice;

each of said projections of said array having a longitudinal length at least one-half of said minor dimension of said terminal orifice; and each of said projections of said array defining a distal end enabling said array of projections to divide the large aggregates of particulate material into smaller aggregates of particulate material for dispensing through the terminal orifice.

2. An anti-clog device for a terminal orifice of a dispenser as set forth in claim 1, wherein said terminal orifice is defined in a generally planar surface;

each of said projections being secured to said generally planar surface; and each of said projections extending outwardly from said planar surface.

3. An anti-clog device for a terminal orifice of a dispenser as set forth in claim 1, wherein said terminal orifice is defined in a generally planar surface;

each of said projections being unitary with said planar surface; and each of said projections extending outwardly from and substantially normal to said planar surface.

4. An anti-clog device for a terminal orifice of a dispenser as set forth in claim 1, wherein said terminal orifice is defined in a generally planar surface of a closure;

each of said projections of said array being unitary with said planar surface of said closure;

each of said projections extending outwardly from and substantially normal to said planar surface; and said closure being removably securable to said receptacle for receiving the particulate material.

5. An anti-clog device for a terminal orifice of a dispenser as set forth in claim 1, wherein said terminal orifice defines a diameter; and each of said projections of said array extends from said planar surface a distance greater than one-half of said diameter of the terminal orifice.

6. An anti-clog device for a terminal orifice of a dispenser as set forth in claim 1, wherein each of said projections of said array having a sharp lateral edge for cutting the aggregates of the particulate material.

7. An anti-clog device for a terminal orifice of a dispenser as set forth in claim 1, wherein each of said projections of said array having plural sharp lateral edges located on opposed sides of each of said projections for cutting the aggregates of the particulate material.

8. An anti-clog device for a terminal orifice of a dispenser as set forth in claim 1, wherein said the terminal orifice comprises a plurality of terminal orifices; and said array of projections comprises a plurality of arrays of projections with an array of projections encircling each of said plurality of terminal orifices of the array of terminal orifices.

9. An anti-clog device for a terminal orifice of a dispenser as set forth in claim 1, wherein said the terminal orifice comprises a plurality of terminal orifices; and said array of projections comprises a plurality of projections with each of said array of projections being interposed between each of said plurality of the arrays of terminal orifices.

10. An anti-clog device for a terminal orifice of a dispenser as set forth in claim 1, wherein said the terminal orifice comprises a plurality of terminal orifices; and said array of projections comprises a plurality of projections with each of said array of projections having a serrated edge defined by a plurality of teeth.

11. An anti-clog device for a terminal orifice of a dispenser for dispensing a particulate material from the terminal orifice, the particulate material clustering into aggregates larger than the terminal orifice and being prevented from being dispensed through the terminal orifice, the improvement comprising:

an array of projections disposed about the terminal orifice;

each of said projections in said array being spaced relative to one another at a distance less than a minor dimension of the terminal orifice;

each of said projections of said array having a longitudinal length at least one-half of said minor dimension of said terminal orifice; and each of said projections of said array defining a pointed distal end enabling said array of projections to divide the large aggregates of particulate material into smaller aggregates of particulate material for dispensing through the terminal orifice.

12. An anti-clog device for a terminal orifice of a dispenser as set forth in claim 11, wherein said terminal orifice is defined in a generally planar surface;

each of said projections of said array having a proximal end secured to said generally planar surface; and each of said projections extending outwardly from and substantially normal to said planar surface.

13. An anti-clog device for a terminal orifice of a dispenser as set forth in claim 11, wherein said terminal orifice is defined in a generally planar surface;

each of said projections of said array having a proximal end being unitary with said planar surface; and each of said projections extending outwardly from and substantially normal to said planar surface.

14. An anti-clog device for a terminal orifice of a dispenser as set forth in claim 11, wherein said terminal orifice is defined in a generally planar surface of a closure;

each of said projections of said array having a proximal end being unitary with said planar surface of said closure;

each of said projections extending outwardly from and substantially normal to said planar surface; and said closure being removably securable to said receptacle for receiving the particulate material.

15. An anti-clog device for a terminal orifice of a dispenser as set forth in claim 11, wherein said terminal orifice is substantially circular defined by a diameter; and each of said projections of said array extends from said planar surface a distance greater than one-half of said diameter of the terminal orifice.

16. An anti-clog device for a terminal orifice of a dispenser as set forth in claim 11, wherein each of said projections of said array having a sharp lateral edge for cutting the aggregates of the particulate material.

17. An anti-clog device for a terminal orifice of a dispenser as set forth in claim 11, wherein each of said projections of said array having plural sharp lateral edges located on opposed sides of each of said projections for cutting the aggregates of the particulate material.

18. An anti-clog device for a terminal orifice of a dispenser as set forth in claim 11, wherein said the terminal orifice comprises a plurality of terminal orifices; and said array of projections comprises a plurality of arrays of projections with an array of projections encircling each of said plurality of terminal orifices of the array of terminal orifices.

19. An anti-clog device for a terminal orifice of a dispenser as set forth in claim 11, wherein said the terminal orifice comprises a plurality of terminal orifices; and said array of projections comprises a plurality of projections with each of said array of projections being interposed between each of said plurality of the arrays of terminal orifices.

20. An anti-clog device for a terminal orifice of a dispenser for dispensing a particulate material from the terminal orifice, the particulate material clustering into aggregates larger than the terminal orifice and being prevented from being dispensed through the terminal orifice, the improvement comprising:

an array of projections disposed across the terminal orifice;

each of said projections in said array being spaced relative to one another at a distance less than a minor dimension of the terminal orifice;

each of said projections comprising a serrated edge having a plurality of teeth enabling said array of projections to divide the large aggregates of particulate material into smaller aggregates of particulate material for dispensing through the terminal orifice.

21. An anti-clog device for a terminal orifice of a dispenser as set forth in claim 20, wherein said terminal orifice is defined in a generally planar surface;

each of said projections being secured to said generally planar surface; and each of said projections extending outwardly from said planar surface.

22. An anti-clog device for a terminal orifice of a dispenser as set forth in claim 20, wherein said terminal orifice is defined in a generally planar surface;

each of said projections being secured to said generally planar surface; and each of said projections being spaced from said planar surface.

23. An anti-clog device for a terminal orifice of a dispenser as set forth in claim 20, wherein said terminal orifice is defined in a generally planar surface;

each of said projections extending outwardly from said planar surface in a form of an arc.

24. An anti-clog device for a terminal orifice of a dispenser as set forth in claim 20, wherein said terminal orifice is defined in a generally planar surface;

each of said projections defining an are with opposed terminal ends of said arc being secured to said generally planar surface.

* * * * *